US008188960B2

(12) United States Patent
Lee

(10) Patent No.: US 8,188,960 B2
(45) Date of Patent: May 29, 2012

(54) DRIVING APPARATUS HAVING SECOND LOAD SIGNAL WITH DIFFERENT FALLING TIMES AND METHOD FOR DISPLAY DEVICE AND DISPLAY DEVICE INCLUDING THE SAME

(75) Inventor: Sang-Keun Lee, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 924 days.

(21) Appl. No.: 12/043,525

(22) Filed: Mar. 6, 2008

(65) Prior Publication Data

US 2009/0009494 A1 Jan. 8, 2009

(30) Foreign Application Priority Data

Jul. 5, 2007 (KR) ..... 10-2007-0067466

(51) Int. Cl.
*G09G 3/36* (2006.01)

(52) U.S. Cl. ..... 345/94; 345/100

(58) Field of Classification Search ..... 345/98, 345/204, 99, 100, 94
See application file for complete search history.

(56) References Cited

U.S. PATENT DOCUMENTS

| | | | | |
|---|---|---|---|---|
| 6,982,707 | B2 | 1/2006 | Wang | |
| 2003/0038766 | A1 * | 2/2003 | Lee et al. | 345/87 |
| 2004/0227714 | A1 * | 11/2004 | Furuichi | 345/98 |
| 2005/0243049 | A1 * | 11/2005 | Ueda | 345/98 |
| 2006/0034144 | A1 | 2/2006 | Weitbruch et al. | |
| 2006/0193002 | A1 | 8/2006 | Satou et al. | |
| 2007/0008273 | A1 | 1/2007 | Chen et al. | |
| 2007/0152947 | A1 * | 7/2007 | Tanaka et al. | 345/100 |
| 2007/0285409 | A1 * | 12/2007 | Fukuo | 345/204 |

FOREIGN PATENT DOCUMENTS

| | | |
|---|---|---|
| CN | 1620628 | 5/2005 |
| JP | 2005284217 | 10/2005 |
| JP | 2006227104 | 8/2006 |
| JP | 2006235118 | 9/2006 |
| JP | 2006267999 | 10/2006 |
| KR | 1020040077016 | 9/2004 |
| KR | 1020050008880 | 1/2005 |
| KR | 1020050063566 | 6/2005 |
| KR | 100504544 | 7/2005 |
| KR | 1020050067247 | 7/2005 |
| KR | 100623791 | 9/2006 |
| KR | 1020060105699 | 10/2006 |

* cited by examiner

*Primary Examiner* — Chanh Nguyen
*Assistant Examiner* — Jonathan Blancha
(74) *Attorney, Agent, or Firm* — Cantor Colburn LLP

(57) ABSTRACT

An apparatus for driving a display device includes a plurality of data driving integrated circuits which generates data voltages and a signal controller which inputs a first load signal to a data driving integrated circuit of the plurality of data driving integrated circuits to control the data driving integrated circuit. Each data driving integrated circuit of the plurality of data driving integrated circuits includes a load signal converter which generates a second load signal having a falling time which is different than a falling time of the first load signal.

19 Claims, 6 Drawing Sheets

DRIVING APPARATUS HAVING SECOND LOAD SIGNAL WITH DIFFERENT FALLING TIMES AND METHOD FOR DISPLAY DEVICE AND DISPLAY DEVICE INCLUDING THE SAME

This application claims priority to Korean Patent Application No. 10-2007-0067466, filed on Jul. 5, 2007, and all the benefits accruing therefrom under 35 U.S.C. §119, the contents of which in its entirety are herein incorporated by reference.

BACKGROUND OF THE INVENTION (a) Field of the Invention

The present invention relates to an apparatus for driving a display device, a driving method for the apparatus and a display device having the apparatus. More particularly, the present invention relates to an apparatus and driving method thereof for a display device having reduced electromagnetic interference ("EMI").

(b) Description of the Related Art

Generally, a liquid crystal display ("LCD") includes a first panel having pixel electrodes and a second panel having a common electrode, and a liquid crystal layer with dielectric anisotropy interposed therebetween. The pixel electrodes are arranged in a substantially matrix pattern, and are each connected to a switching element such as a thin film transistor ("TFT") through which data signals are sequentially applied to rows of the pixel electrodes. A common voltage is applied to the common electrode, which extends over substantially an entire area of a surface of the second panel. Thus, each individual pixel electrode and the common electrode, having the liquid crystal layer disposed therebetween, form a liquid crystal capacitor. A switching element, e.g., the TFT, connected to the liquid crystal capacitor forms a basic unit for a pixel of the LCD.

Voltages applied to the first panel and the second panel, e.g., the data voltages applied to the pixel electrodes and the ground voltage applied to the common electrode, generate an electric field in the liquid crystal layer. Varying an intensity of the electric field controls a transmittance of light passing through the liquid crystal layer, thereby displaying a desired image. To prevent the liquid crystal layer from deteriorating due to continual application of a unidirectional electric field, a voltage polarity of the data signal with respect to the common voltage is inverted for every frame, pixel or pixel row, for example.

Most display devices, including LCDs, have problems of electromagnetic interference ("EMI"), particularly in LCDs with increased operating frequencies, for example. Thus, it is desired to develop a display device having reduced EMI.

BRIEF SUMMARY OF THE INVENTION

An apparatus for driving a display device according to an exemplary embodiment of the present invention includes a plurality of data driving integrated circuits ("ICs") which generates data voltages and a signal controller which inputs a first load signal to a data driving IC of the plurality of data driving ICs to control the data driving IC.

Each data driving IC of the plurality of data driving ICs includes a load signal converter which generates a second load signal having a falling time which is different than a falling time of the first load signal.

The load signal converter may generate the second load signal according to a random signal input to the load signal converter.

The load signal converter may include a first voltage source, a second voltage source, a current mirror connected between the first voltage source and the second voltage source and having a resistor and a plurality of first transistors, an inverter connected to the current mirror, a plurality of second transistors each connected in electrical parallel with each other and being connected between the first voltage source and the current mirror, and a pseudo random binary sequence ("PRBS") generator connected to the plurality of second transistors.

The PRBS generator may include a plurality of cascaded flip-flops, and an output terminal of each flip-flop of the plurality of flip-flops may be connected to a control terminal of a corresponding second transistor of the plurality of second transistors.

A first flip-flop of the plurality of flip-flops may receive an input signal through a logic circuit. The input signal may have an arbitrary value and be selected from the output terminal of each flip-flop of the plurality of cascaded flip-flops of the pseudo random binary sequence generator.

Respective sizes of each second transistor of the plurality of second transistors may be different from each other.

The resistor of the current source may be connected to the first voltage source, and the plurality of first transistors of the current mirror may include a third transistor connected to the resistor and a fourth transistor connected between the third transistor and the second voltage source. A fifth transistor, a sixth transistor, a seventh transistor and an eighth transistor may be connected in electrical series with each other and all connected between the first voltage source and the second voltage source, and a control terminal and an input terminal of the third transistor may be connected to a control terminal of the fifth transistor, and a control terminal and an input terminal of the fourth transistor are connected to a control terminal of the eighth transistor.

A control terminal of the sixth transistor and a control terminal of the seventh transistor may receive the first load signal from the signal controller, an output terminal of each second transistor of the plurality of second transistors may be connected to an output terminal of the fifth transistor and an input terminal of the sixth transistor, and an input terminal of the inverter may be connected to an output terminal of the sixth transistor and an input terminal of the seventh transistor.

The third transistor, the fourth transistor, the seventh transistor and the eighth transistor may be N-type transistors, and the fifth transistor and the sixth transistor may be P-type transistors.

The data driving IC may further include a shift register, a latch connected to the shift register, a digital to analog ("D/A") converter connected to the latch and a buffer connected to the D/A converter.

A display device according to an exemplary embodiment of the present invention includes a plurality of data lines, a plurality of data driving ICs which applies data voltages to the plurality of data lines, and a signal controller which inputs a first load signal to a data driving IC of the plurality of data driving ICs to control the data driving IC.

Each data driving IC of the plurality of data driving ICs includes a load signal converter which generates a second load signal having a falling time which is different than a falling time of the first load signal. The load signal converter may generate the second load signal according to a random signal input to the load signal converter.

The load signal converter may include a first voltage source, a second voltage source, a current mirror connected between the first voltage source and the second voltage source, and having a resistor and a plurality of first transistors, an inverter connected to the current mirror, a plurality of second transistors each connected in electrical parallel with each other and being connected between the first voltage source and the current mirror, and a PRBS generator connected to the plurality of second transistors.

The PRBS generator may include a plurality of cascaded flip-flops, and an output terminal of each flip-flop of the plurality of flip-flops is connected to a control terminal of a corresponding second transistor of the plurality of second transistors.

A first flip-flop of the plurality of flip-flops may receive an input signal through a logic circuit and the input signal may have an arbitrary value and be selected from the output terminal of each flip-flop of the plurality of cascaded flip-flops of the PRBS generator.

Respective sizes of each second transistor of the plurality of second transistors may be different from each other.

The resistor of the current source may be connected to the first voltage source, and the plurality of the first transistors may include a third transistor connected to the resistor, a fourth transistor connected between the third transistor and the second voltage source, and a fifth transistor, a sixth transistor, a seventh transistor and an eighth transistor connected in electrical series with each other and all connected between the first voltage source and the second voltage source. A control terminal and an input terminal of the third transistor may be connected to a control terminal of the fifth transistor, and a control terminal and an input terminal of the fourth transistor may be connected to a control terminal of the eighth transistor.

A control terminal of the sixth transistor and a control terminal of the seventh transistor may receive the first load signal from the signal controller, an output terminal of each second transistor of the plurality of second transistors may be connected to an output terminal of the fifth transistor and an input terminal of the sixth transistor, and an input of the inverter may be connected to an output terminal of the sixth transistor and an input terminal of the seventh transistor.

The third transistor, the fourth transistor, the seventh transistor and the eighth transistor may be N-type transistors, and the fifth transistor and the sixth transistor may be P-type transistors.

A method for driving a display device according to an exemplary embodiment of the present invention includes outputting a control signal and a digital image signal including a first load signal to a data driving integrated circuit, generating a second load signal with the data driving integrated circuit by receiving the first load signal and converting a falling time of the first load signal, generating a data voltage corresponding to the digital image signal in response to the converted falling time of the second load signal, and applying the data voltage to a data line to display an image.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
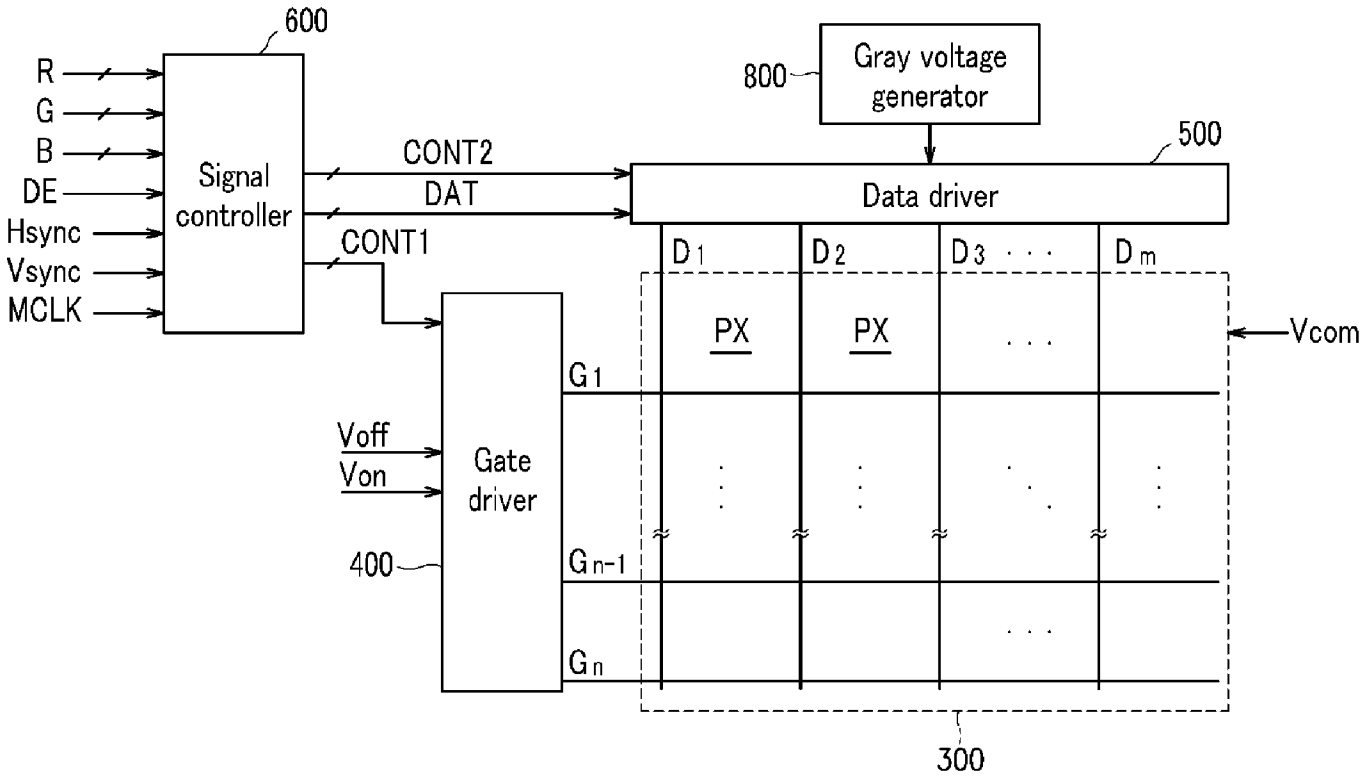
FIG. 1 is a block diagram of a liquid crystal display ("LCD") according to an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, the exemplary embodiments of the present invention will be explained in further detail with reference to the accompanying drawings.

A liquid crystal display ("LCD") according to an exemplary embodiment of the present invention will now be described in further detail with reference to FIGS. 1 and 2.

Figure 2:
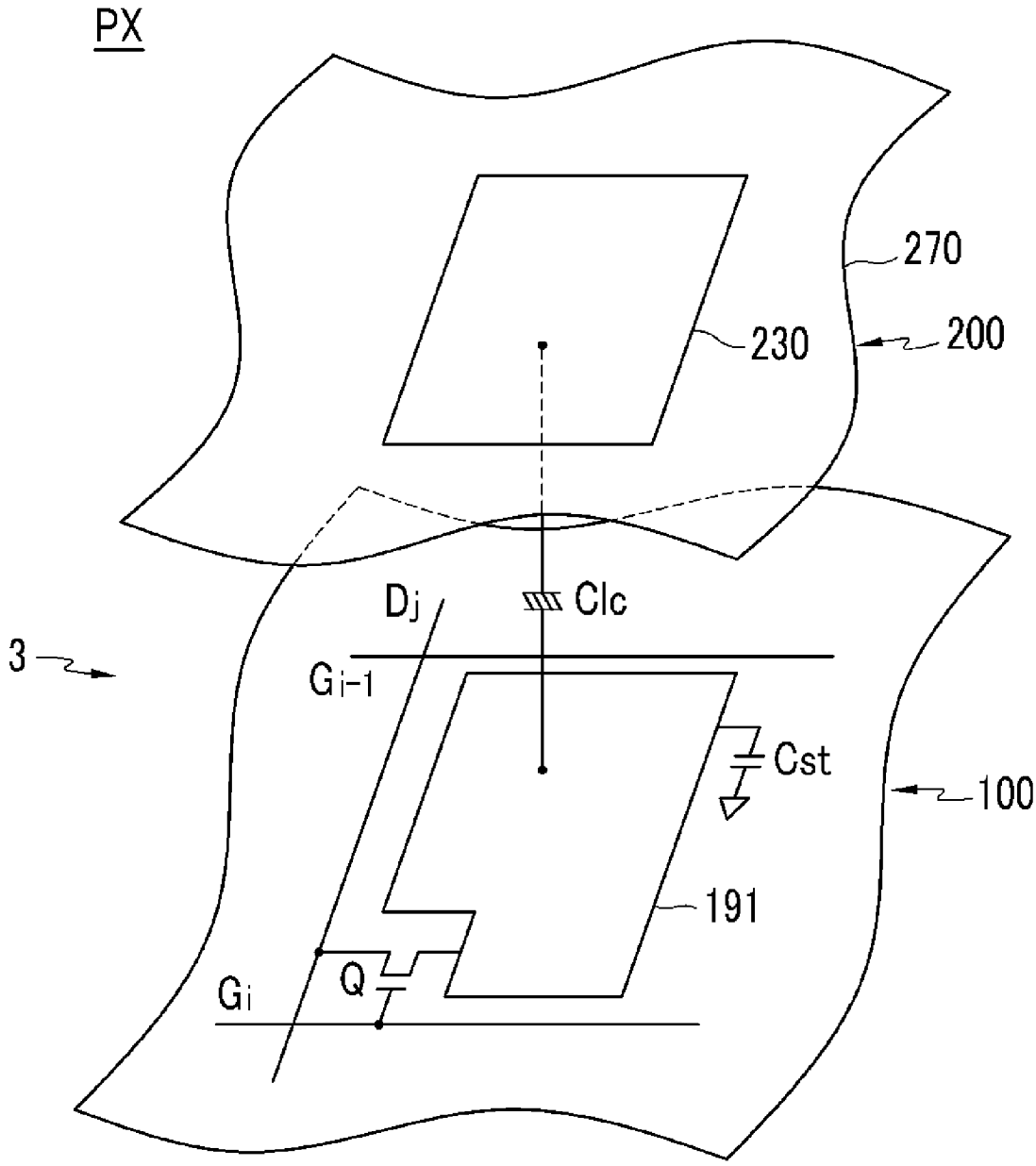
FIG. 2 is an equivalent schematic circuit diagram of a pixel of a liquid crystal display according to an exemplary embodiment of the present invention.
Figure 3:
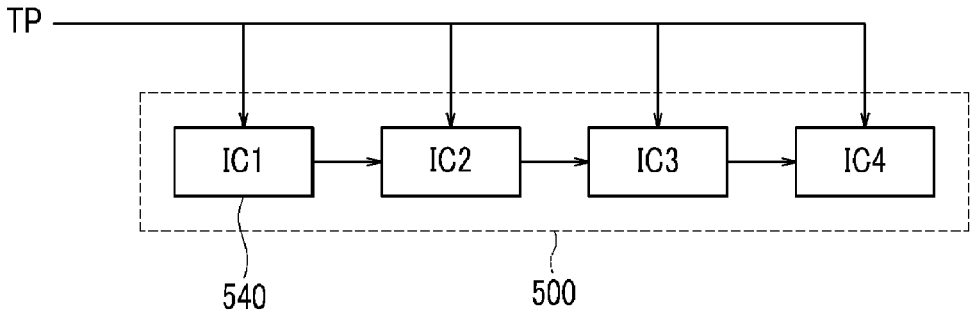
FIG. 3 is a block diagram of a data driver of the liquid crystal display according to the exemplary embodiment of the present invention in FIG. 1.

FIG. 1 is a block diagram of an LCD according to an exemplary embodiment of the present invention, and FIG. 2 is an equivalent schematic circuit diagram of a pixel of an LCD according to an exemplary embodiment of the present invention. FIG. 3 is a block diagram of a data driver of the LCD according to the exemplary embodiment of the present invention in FIG. 1.

Referring to FIG. 1, a liquid crystal display according to an exemplary embodiment of the present invention includes a liquid crystal panel assembly 300, a gate driver 400 and a data driver 500 connected to the liquid crystal panel assembly 300, a gray voltage generator 800 connected to the data driver 500, and a signal controller 600 which controls the liquid crystal panel assembly 300, the gate driver 400, the data driver 500 and the gray voltage generator 800.

Referring to FIGS. 1 and 2, the liquid crystal panel assembly 300 includes gate lines $G_1$-$G_n$ and data lines $D_1$-$D_m$, and pixels PX connected to the gate lines $G_1$-$G_n$ and the data lines $D_1$-$D_m$ and arranged in a substantially matrix structure. Further, the liquid crystal panel assembly 300 includes the a lower panel 100 and an upper panel 200 facing the lower panel 100, and a liquid crystal layer 3 formed between the lower panel 100 and the upper panel 200.

The gate lines $G_1$-$G_n$ transmit gate signals (also called scanning signals) to switching elements Q, and the data lines $D_1$-$D_m$ transmit data signals to the switching elements Q. In addition, the gate lines $G_1$-$G_n$ extend in a substantially row direction and are substantially parallel to each other, while the data lines $D_1$-$D_m$ extend in a substantially column direction, e.g., substantially perpendicular to the gate lines $G_1$-$G_n$, and are substantially parallel to each other, as shown in FIGS. 1 and 2.

Referring to FIG. 2, each pixel PX, for example a pixel PX connected to an i-th gate line $G_i$ (i=1, 2, . . . , n) and a j-th data line $D_j$ (j=1, 2, . . . , m), includes a respective switching element Q connected to the i-th gate line $G_i$ and the j-th data line $D_j$, and a liquid crystal capacitor Clc and a storage capacitor Cst each connected to the respective switching element Q. The storage capacitor Cst may be omitted in alternative exemplary embodiments of the present invention.

Still referring to FIG. 2, the switching element Q is disposed on the lower panel 100 and has three terminals, e.g., a control terminal connected to the i-th gate line Gi, an input terminal connected to the j-th data line $D_j$ and an output terminal connected to both the liquid crystal capacitor Clc and the storage capacitor Cst.

The liquid crystal capacitor Clc includes a pixel electrode 191 disposed on the lower panel 100 and a common electrode 270 disposed on the upper panel 200 as two terminals. The liquid crystal layer 3 disposed between the pixel electrode 190 of the pixel PX and the common electrode 270 functions as a dielectric of the liquid crystal capacitor Clc. Further, the pixel electrode 191 is connected to the switching element Q, and the common electrode 270 is supplied with a common voltage Vcom (FIG. 1) and covers an entire area of a surface of the upper panel 200, as partially shown in FIG. 2. In alternative exemplary embodiments of the present invention, the common electrode 270 may be provided on the lower panel 100, and at least one of the pixel electrode 191 and the common electrode 270 may have a substantially bar shape and/or a substantially stripe shape, but is not limited thereto.

The storage capacitor Cst is an auxiliary capacitor for the liquid crystal capacitor Clc. Further, the storage capacitor Cst includes the pixel electrode 191 and a separate signal line provided on the lower panel 100, overlaps the pixel electrode 191 via an insulator, and is supplied with a predetermined voltage such as the common voltage Vcom. In alternative exemplary embodiments of the present invention (not shown), the storage capacitor Cst may include the pixel electrode 191 and an adjacent gate line (called a previous gate line) which overlaps the pixel electrode 191 via an insulator.

For color display, each pixel of the LCD represents one primary color, for example, (spatial division) or, alternatively, each pixel may sequentially represent one of the primary colors (temporal division) such that a spatial or, alternatively, temporal sum of the primary colors, e.g., red, green and blue, is recognized as a desired color for display. FIG. 2 shows an exemplary embodiment of the present invention using spatial division. More specifically, each pixel PX includes a color filter 230, representing one of the primary colors, for example, in an area of the upper panel 200 facing the pixel electrode 191. In alternative exemplary embodiments of the present invention, the color filter 230 may be provided on or under the pixel electrode 191 on the lower panel 100.

One or more polarizers (not shown) are attached to a surface, e.g., an outer surface, of the liquid crystal panel assembly 300.

Referring again to FIG. 1, the gray voltage generator 800 generates gray voltages. More specifically, the gray voltage generator 800 generates a plurality of positive reference gray voltages and a plurality of negative reference gray voltages, each related to a transmittance of the pixels PX. More specifically, the plurality of positive reference gray voltages has a positive polarity with respect to the common voltage Vcom, while the plurality of negative reference gray voltages has a negative polarity with respect to the common voltage Vcom.

The gate driver 400 synthesizes a gate-on voltage Von and a gate-off voltage Voff to generate gate signals for application to the gate lines $G_1$-$G_n$.

The data driver 500 includes a plurality of data driving integrated circuits 540 (FIG. 3) connected to the data lines $D_1$-$D_m$ of the panel assembly 300, and applies data signals, selected from the gray voltages supplied from the gray voltage generator 800, to the data lines $D_1$-$D_m$. When the gray voltage generator 800 generates only a portion of the positive reference gray voltages or negative reference gray voltages rather than all of the positive reference gray voltages or negative reference gray voltages, the data driver 500 divides the positive reference gray voltages or negative reference gray voltages to generate all of the positive reference gray voltages or negative reference gray voltages and select the data voltages from among the positive reference gray voltages or negative reference gray voltages.

The signal controller 600 controls the gate driver 400 and the data driver 500, but is not limited thereto.

Each of the gate driver 400, the data driver 500, the signal controller 600 and the gray voltage generator 800 may include at least one integrated circuit ("IC") chip mounted on the liquid crystal panel assembly 300 or on a flexible printed circuit ("FPC") film in a tape carrier package ("TCP"), which are attached to the liquid crystal panel assembly 300. Alternatively, at least one of the gate driver 400, the data driver 500, the signal controller 600 and the gray voltage generator 800 may be integrated into the liquid crystal panel assembly 300 along with the gate lines $G_1$-$G_n$ and $D_1$-$D_m$ and the switching elements Q. Furthermore, in an exemplary embodiment, each of the gate driver 400, the data driver 500, the signal controller 600 and the gray voltage generator 800 may be integrated into a single IC chip, but alternative exemplary embodiments are not limited thereto. For example, at least one of the gate driver 400, the data driver 500, the signal controller 600 and the gray voltage generator 800 or at least one circuit element in at least one of the gate driver 400, the data driver 500, the signal controller 600 and the gray voltage generator 800 may be disposed outside the single IC chip.

An operation of the LCD according to an exemplary embodiment of the present invention will now be described in further detail with reference to FIG. 1.

The signal controller 600 is supplied with a red input image signal R, a green input image signal G and a blue input image signal B, for example, and additional input control signals, described below, for controlling the LCD, from an outside graphics controller (not shown). The red input image signal R, the green input image signal G and the blue input image signal B include luminance information for each pixel PX, e.g., luminance information including a predetermined number of gray levels, such as $1024(=2^{10})$, $256(=2^8)$ or $64(=2^6)$ gray levels, for example, but not being limited thereto. The additional input control signals include, for example, a vertical synchronization signal Vsync, a horizontal synchronization signal Hsync, a main clock signal MCLK and a data enable signal DE.

The signal controller 600 uses the input control signals and the red input image signal R, the green input image signal G and the blue input image signal B to generate a gate control signal CONT1, a data control signal CONT2 and a processed image signal DAT based upon the red input image signal R, the green input image signal G and the blue input image signal B in accordance with a desired operation of the liquid crystal panel assembly 300. Further, the signal controller 600 sends the gate control signal CONT1 to the gate driver 400 and sends the processed image signal DAT and the data control signal CONT2 to the data driver 500. In an exemplary embodiment, the processed image signal DAT is a digital signal having a predetermined number of values, e.g., gray scales, but alternative exemplary embodiments of the present invention are not limited thereto.

The gate control signal CONT1 includes a scanning start signal STV (not shown) for instructing the gate driver 400 to start scanning, at least one gate clock signal (not shown) for controlling an output time of the gate-on voltage Von and at least one output enable signal OE (not shown) for defining a duration of the gate-on voltage Von.

The data control signal CONT2 includes a horizontal synchronization start signal STH (not shown) for instructing the data driver 500 of a start of transmission of the processed image signal DAT of one pixel row, a first load signal TP (FIGS. 3 and 4) for instructing the data driver 500 to apply data signals to the liquid crystal panel assembly 300 and a data clock signal HCLK (not shown). The data control signal CONT2 further includes a polarity signal POL (FIG. 4) for reversing a polarity of voltages of the data signal with respect to the common voltage Vcom.

In response to the data control signal CONT2 from the signal controller 600, the data driver 500 receives the processed image signal DAT for a row of pixels from the signal controller 600, converts the processed image signal DAT into the data signal having analog data voltages by selecting gray voltages corresponding to the processed image signal DAT, and applies the data signal to the data lines $D_1$-$D_m$.

The gate driver 400 applies the gate-on voltage Von to a gate line $G_1$-$G_n$ in response to the scanning control signal CONT1 from the signal controller 600, thereby turning on the associated switching transistors Q connected thereto. The data signals applied to the data lines $D_1$-$D_m$ are then supplied to the pixels PX through the turned on, e.g., activated, switching transistors Q.

A voltage difference between a voltage of a data signal applied to a respective pixel PX and the common voltage Vcom is a charged voltage of the liquid crystal capacitor Clc of the pixel PX, which is also referred to as a pixel voltage. Liquid crystal molecules in the liquid crystal capacitor Clc are oriented depending on a magnitude of the pixel voltage, and the orientation of th liquid crystal molecules thereby determines a polarization of light passing through the liquid crystal layer 3. The polarizer converts the polarization of the light into a light transmittance such that the pixel PX has a luminance represented by the data signal, e.g., proportional to a gray voltage level of the data signal.

By repeating the procedure described above for each horizontal period ("1H") equal to one period of the horizontal synchronization signal Hsync and the data enable signal DE, the gate lines $G_1$-$G_n$ are sequentially supplied with the gate-on voltage Von, thereby applying the data signal to all pixels PX to display an image for one frame.

When a subsequent frame starts after a previous frame finishes, the inversion control signal RVS applied to the data driver 500 is controlled such that a polarity of the data signal is reversed (frame inversion). In alternative exemplary embodiments, the inversion control signal RVS may also be controlled such that a polarity of data signal in a given data line of the data lines $D_1$-$D_m$ is periodically reversed during one frame (row inversion and dot inversion), or a polarity of the data signal in one packet may be reversed (column inversion and dot inversion).

The data driver 500 of a liquid crystal display according to an exemplary embodiment of the present invention will now be described in further detail with reference to FIGS. 4-8.

Figure 4:
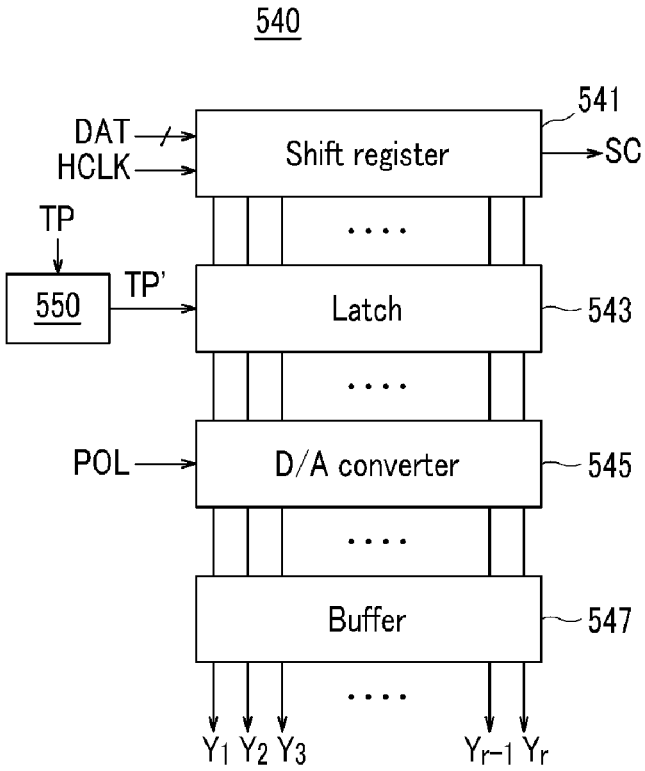
FIG. 4 is a block diagram of a data driving integrated circuit ("IC") of the data driver according to the exemplary embodiment of the present invention in FIG. 3.
Figure 5:
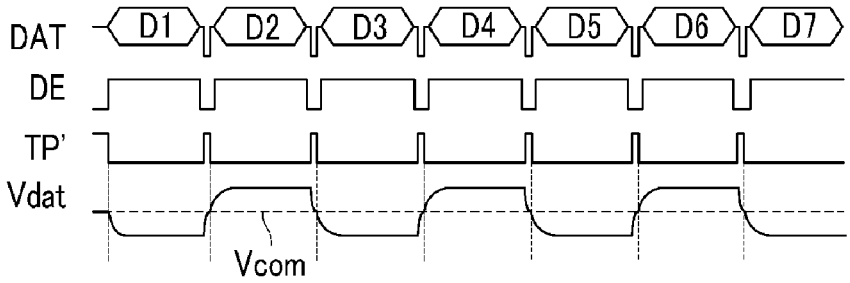
FIG. 5 is a signal timing chart illustrating driving signals of a liquid crystal display according to an exemplary embodiment of the present invention.
Figure 6:
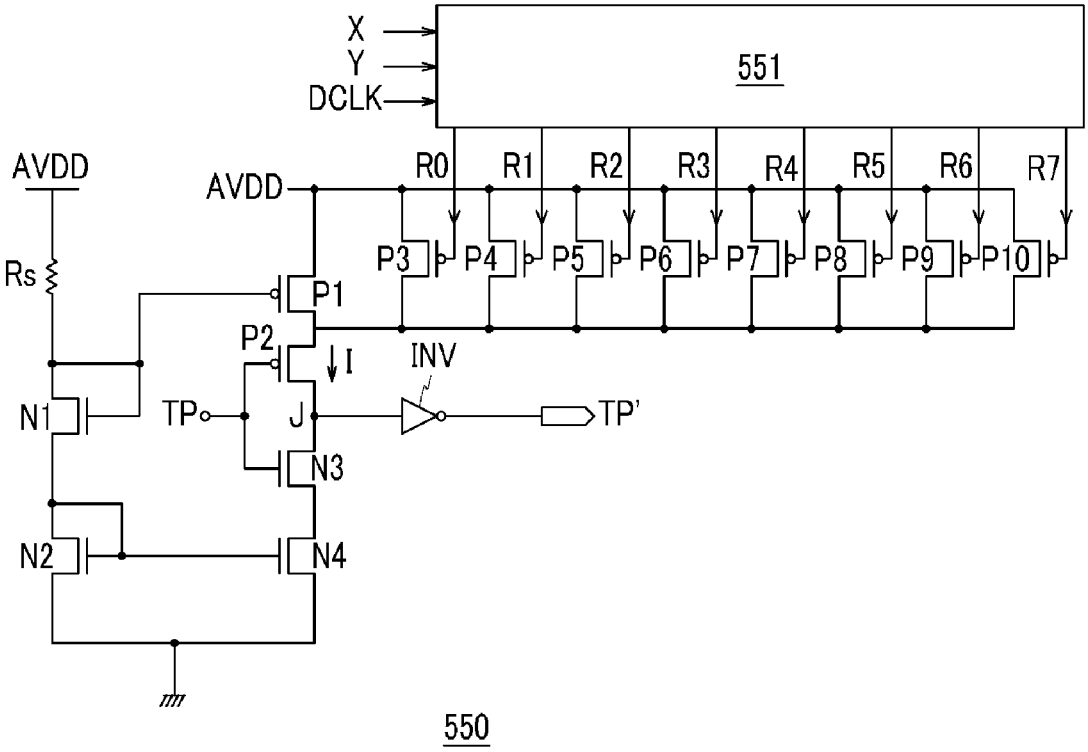
FIG. 6 is a schematic circuit diagram of a load signal converter of the data driver according to the exemplary embodiment of the present invention in FIG. 4.
Figure 7:
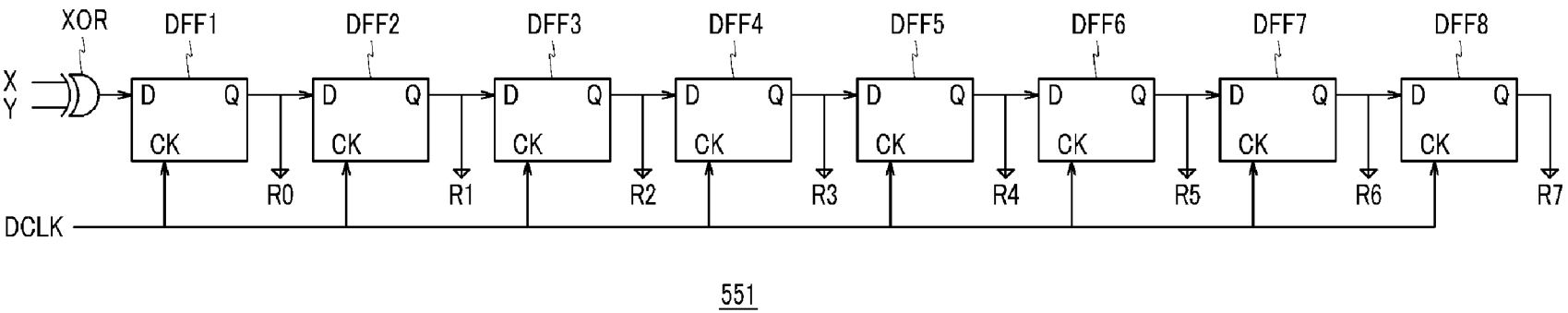
FIG. 7 is a schematic circuit diagram of a pseudo random binary sequence ("PRBS") generator of the load signal converter of the data driver according to the exemplary embodiment of the present invention in FIG. 6.
Figure 8:
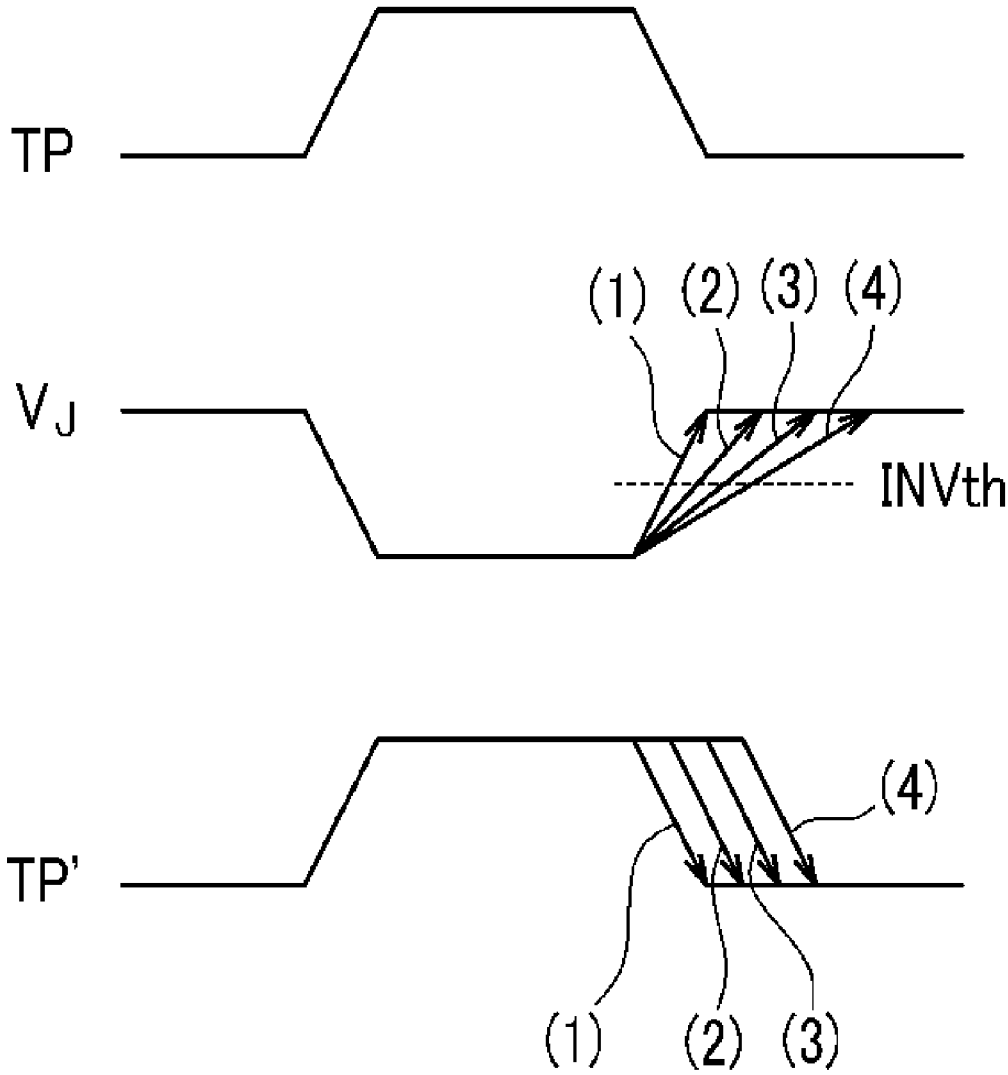
FIG. 8 is a signal waveform illustrating load signals before and after a function of the load signal converter of the data driver according to the exemplary embodiment of the present invention in FIG. 6.

FIG. 4 is a block diagram of a data driving IC of the data driver according to the exemplary embodiment of the present invention in FIG. 3, FIG. 5 is a signal timing chart illustrating driving signals of a liquid crystal display according to an exemplary embodiment of the present invention, FIG. 6 is a schematic circuit diagram of a load signal converter of the data driver according to the exemplary embodiment of the present invention in FIG. 4, FIG. 7 is a schematic circuit diagram of a pseudo random binary sequence ("PRBS") generator of the load signal converter of the data driver according to the exemplary embodiment of the present invention in FIG. 6, and FIG. 8 is a signal waveform illustrating load signals before and after a function of the load signal converter of the data driver according to the exemplary embodiment of the present invention in FIG. 6.

The data driver 500 includes at least one data driving IC 540 as shown in FIG. 3. More specifically, in the exemplary embodiment shown in FIG. 3, the data driver 500 includes four data driving ICs 540, e.g., IC1, IC2, IC3 and IC4, but alternative exemplary embodiments are not limited thereto.

Referring to FIG. 4, the data driving IC 540 according to an exemplary embodiment of the present invention includes a shift register 541, a latch 543, a digital to analog converter 545 and a buffer 547 and a load signal converter 550. As shown in FIG. 4, the shift register 541, the latch 543, the digital to analog converter 545 and the buffer 547 are cascaded, e.g., are sequentially connected to each other, while the load signal converter is connected to the latch 453.

The shift register 541 of the data driving IC 540 sequentially shifts the processed image signal DAT input according to the data clock signal HCLK to sequentially transmit the processed image signal DAT to the latch. Thus, the shift register 541 shifts the processed image data DAT and outputs a shift clock signal SC to a shift register 541 of a subsequent data driving IC 540. More specifically, the shift register 541 in the data driving IC 540 labeled IC1 in FIG. 3 outputs the shift clock signal SC to a shift register 541 in the subsequent data driving IC 540 labeled IC2 in FIG. 3.

The latch 543 receives the processed image signal DAT from the shift register 541 and stores the processed image signal DAT before outputting the processed image signal DAT to the digital to analog converter 545 at a falling edge of a second load signal TP' outputted from the load signal converter 550.

The digital to analog converter 545 converts the processed image signal DAT, which is a digital signal, supplied from the latch 543 into analog data voltages and outputs them to the buffer 547. The analog data voltages have either a positive value or a negative value with respect to a common voltage Vcom according to the polarity signal POL of the data control signal CONT2 supplied from the signal controller 600 (FIG. 1).

Finally, the buffer 547 outputs the analog data voltages supplied from the digital to analog converter 545 via output terminals $Y_1$-$Y_r$. The output terminals $Y_1$-$Y_r$ are connected to the corresponding data lines $D_1$-$D_m$ (FIGS. 1 and 2).

Referring to FIG. 5, in an exemplary embodiment, a current processed image signal DAT, e.g., D1, is passed through the latch 543, the digital-analog converter 545 and the buffer 547 at a falling edge of the second load signal TP', and the analog data voltages are thereby outputted to the data lines D1-Dm via the output terminals $Y_1$-$Y_r$.

When the second load signal TP' changes to a high level, however, the data driving IC 540 connects each output terminals of the output terminals $Y_1$-$Y_r$ to each other. Since polarities of the analog data voltages outputted though the output terminals $Y_1$-$Y_r$ are different from each other, when the output terminals $Y_1$-$Y_r$ are connected to each other the positive data line voltages Vdat and negative data line voltages Vdat applied to corresponding data lines $D_1$-$D_m$ are connected to each other, thereby applying a charge-sharing voltage at a level substantially equal to a level of the common voltage Vcom, e.g., an intermediate level of the positive data line voltages Vdat and the negative data line voltages Vdat, to each output terminal of the output terminals $Y_1$-$Y_r$. Thereafter, when the second load signal TP' changes again to a low level, a subsequent processed image signal DAT, e.g., D2, stored in the latch 543 is converted into an analog data voltage and is then outputted to the output terminals $Y_1$-$Y_r$.

Referring now to FIG. 6, the load signal converter 550 of the data driving IC 540 according to an exemplary embodiment of the present invention includes: a first N-type transistor N1, a second N-type transistor N2, a third N-type transistor N3 and a N-type fourth transistor N4; first through tenth P-type transistors P1 through P10, respectively; an inverter INV; and a PRBS generator 551.

In addition, a resistor Rs, the first N-type transistor N1 and the second N-type transistor N2 are connected in electrical series with each other between a driving voltage AVDD and a ground voltage, while the first P-type transistor P1, the second P-type transistor P2, the third N-type transistor N3 and the fourth N-type transistor N4 are connected in electrical series with each other between the driving voltage AVDD and the ground voltage.

Still referring to FIG. 6, an input terminal and a control terminal of the first N-type transistor N1 are connected to a control terminal of the first P-type transistor P1, and an input terminal and a control terminal of the second N-type transistor N2 are connected to a control terminal of the fourth N-type transistor N4. Further, the first load signal TP from the signal controller 600 is output to control terminals of the second P-type transistor P2 and the third N-type transistor N3.

In an exemplary embodiment, a magnitude of the driving voltage AVDD is substantially the same as a magnitude of a high level of the first load signal TP, but alternative exemplary embodiments are not limited thereto.

Furthermore, the third through tenth P-type transistors P3 through P10, respectively, are connected in electrical parallel with each other between the driving voltage AVDD and a junction of the first P-type transistor P1 and the second P-type transistor P2. In addition, respective control terminals of the third through tenth P-type transistors P3 through P10, respectively, receive first through eighth outputs R0 through R7, respectively, from the PRBS generator 551. Finally, an inverter INV is connected to a junction J between the second P-type transistor P2 and the third N-type transistor N3.

Referring to FIG. 7, the PRBS generator 551 includes cascaded first through eighth flip-flops DFF1 through DFF8, respectively. Each respective input terminal D of each of the first through eighth flip-flops DFF1 through DFF8, respectively, is connected to an output terminal Q of a previous flip-flop, and a clock terminal CK receives a clock signal DCLK and thereby generates a predetermined output according to the clock signal DCLK. Instead of receiving an output terminal Q or a previous flip-flop, however, the first flip-flop DFF1 receives a first arbitrary input X and a second arbitrary input Y through an exclusive—or operation circuit, e.g., gate, XOR.

In alternative exemplary embodiments, a logic circuit other than the exclusive-or operation circuit XOR may be used instead The first arbitrary input X and the second arbitrary input Y may be selected from among the first through eighth outputs R0 though R7, respectively, generated by the PRBS generator 551, for example, but alternative exemplary embodiments are not limited thereto. Furthermore, in an exemplary embodiment, the clock signal DCLK is a separate signal, or a phase locked loop ("PLL") or a delay locked loop ("DLL") may be used in the data driving IC 540 may be used in alternative exemplary embodiments of the present invention.

An operation of the load signal converter 550 according to an exemplary embodiment of the present invention will now be described in further detail with reference to FIGS. 6-8.

When the first load signal TP changes from a low level to a high level, the third N-type transistor N3 is turned on such that the ground voltage, e.g., a low level, is applied to the inverter INV, and a high level is therefore outputted from the inverter INV. Thus, the second load signal TP' also changes from a low level to a high level when the first load signal TP changes from the low level to the high level, as shown in FIG. 8.

When the first load signal TP is changes from the high level to the low level, the second P-type transistor P2 is turned on and the third N-type transistor N3 is simultaneously turned off. Accordingly, a current I flows to the input of the inverter INV, and the second load signal TP' is therefore changed from the high level to the low level by the inverter INV.

In an exemplary embodiment, each of the first through eighth outputs R0 through R7, respectively, generated in the PRBS generator 551 has two levels to turn on or turn off the third through tenth transistors P3 through P10, respectively, such that the third through tenth transistors P3 through P10, respectively, are turned on or turned off according to a value of the two levels of each of the first through eighth outputs R0 through R7, respectively and a value of the current I changes. As shown in FIG. 8, the change in the amount of the current I determines a time when the second load signal TP' changes from the high level to the low level.

More specifically, referring to FIG. 8, when a value of the current I is relatively large, a voltage $V_J$ at the input terminal of the inverter INV is rapidly increased, and when the value of the current I is relatively small, the voltage $V_J$ acting on the input terminal of the inverter INV is increased less rapidly. Thus, as seen in FIG. 8, in an exemplary embodiment of the present invention having four sequences (1), (2), (3) and (4) in which the voltage $V_J$ is more slowly increased (e.g., the voltage $V_J$ increases less rapidly in sequence (4) than in sequence (3), the voltage $V_J$ increases less rapidly in sequence (3) than in sequence (2), and the voltage $V_J$ increases less rapidly in sequence (2) than in sequence (1) is shown. In FIG. 8, a threshold voltage INVth of the inverter INVis indicated by a dotted line, and a high level is output when the voltage $V_J$ is less than the threshold voltage INVth while a low level is output when the voltage $V_J$ is greater than the threshold voltage INVth.

Accordingly, an output of the inverter INV, e.g., a falling edge of the second load signal TP', drops according to the increase of the input voltage $V_J$ of the inverter INV.

Referring again to FIG. 6, a value of the current I is controlled according to a size of the third through tenth P-type transistors P3 through P10, respectively. Further, in an exemplary embodiment of the present invention, sizes of the third through tenth P-type transistors P3 through P10, respectively, are different. For example, a ratio of sizes of the third through tenth P-type transistors P3 through P10, respectively, may be 1:2:3:4:5:6:7:8, respectively, but is not limited thereto.

When sizes of the third through tenth P-type transistors P3 through P10, respectively, are the same, values of the firth through eighth outputs R0 through R7, respectively, of the PRBS generator 551 are each 8 bits, and the same output may therefore be generated with eight different values. For example, when values of the first through eight outputs R0 through R7, respectively, are "00000001" the current generated in each of the transistors P3-P10 are substantially the same as when the values of the first through eight outputs R0 through R7, respectively, are "00000010".

As described above, the analog data voltage is applied to the data lines $D_1$-$D_m$ according to the falling edge of the second load signal TP'. Further, when the first arbitrary input X and the second arbitrary input Y input to the PRBS generator 551 are different for associated data driving ICs 540, such as when a first data driving IC 540 (e.g., IC1 in FIG. 3) receives a first output R0 and the second output R1 as a first arbitrary input and a second arbitrary input Y, respectively, and a second data driving IC 540 (e.g., IC2 in FIG. 3) receives the second output R1 and the fourth output R3 as a first arbitrary input and a second arbitrary input Y, respectively, values of the first through eight outputs R0 through R7, respectively, from the PRBS generator 551 are different.

Therefore, times at which data voltages are applied to respective data lines $D_1$-$D_m$ are different, and electromagnetic interference ("EMI") generated when data voltages are simultaneously applied to the data lines $D_1$-$D_m$ is substantially decreased or effectively reduced.

More specifically, when all data driving ICs 540 simultaneously apply data voltages to data lines $D_1$-$D_m$ synchronized to a falling edge of the first load signal TP, as in an LCD of the prior art, driving voltages of the display device fluctuate, thereby generating substantial EMI. However, as described in greater detail above, in an LCD according to an exemplary embodiment of the present invention, a falling time of a second load signal TP' is different for respective data driving ICs 540 such that an application time of data voltages is different, thereby substantially reducing EMI in the LCD of the present invention.

Thus, as described herein, a load signal converter determines different falling times of a load signal, and EMI is thereby substantially reduced.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for driving a display device, the apparatus comprising:

a plurality of data driving integrated circuits which generates data voltages; and a signal controller which inputs a first load signal to the plurality of data driving integrated circuits to control the data driving integrated circuits, wherein each data driving integrated circuit of the plurality of data driving integrated circuits comprises a load signal converter which generates a second load signal based on the first load signal, and a time when the second load signal begins to rise is the same and begins to fall from high level to low level varies for each data driving integrated circuit of the plurality of data driving integrated circuits.

2. The apparatus of claim 1, wherein the load signal converter comprises:

a first voltage source;

a second voltage source;

a load signal buffer electrically connected to the first voltage source and the second voltage source, receiving the first load signal and outputting the second load signal;

a plurality of first transistors each connected in electrical parallel with each other, the plurality of second transistors being connected between the first voltage source and the load signal buffer and supplying bias current to the load signal buffer; and a pseudo random binary sequence generator connected to the plurality of first transistors.

3. The apparatus of claim 2, wherein the pseudo random binary sequence generator includes a plurality of cascaded flip-flops, and an output terminal of each flip-flop of the plurality of flip-flops is connected to a control terminal of a corresponding first transistor of the plurality of first transistors.

4. The apparatus of claim 3, wherein a first flip-flop of the plurality of flip-flops receives an input signal through a logic circuit, the input signal having an arbitrary value and being selected from the output terminal of each flip-flop of the plurality of cascaded flip-flops of the pseudo random binary sequence generator.

5. The apparatus of claim 3, wherein the load signal buffer comprise:

an inverter;

a resistor connected to the first voltage source; and a second transistor connected to the resistor;

a third transistor connected between the second transistor and the second voltage source; and a fourth transistor, a five transistor, a sixth transistor and a seventh transistor connected in electrical series with each other and all connected between the first voltage source and the second voltage source, wherein a control terminal and an input terminal of the second transistor are connected to a control terminal of the fourth transistor, and a control terminal and an input terminal of the third transistor are connected to a control terminal of the seventh transistor.

6. The apparatus of claim 5, wherein a control terminal of the sixth transistor and a control terminal of the seventh transistor receive the first load signal from the signal controller, an output terminal of each first transistor of the plurality of first transistors is connected to an output terminal of the fourth transistor and an input terminal of the fifth transistor, and an input terminal of the inverter is connected to an output terminal of the fifth transistor and an input terminal of the sixth transistor.

7. The apparatus of claim 6, wherein the second transistor, the third transistor, the sixth transistor, and the seventh transistor are N-type transistors, and the fourth transistor and the fifth transistor are P-type transistors.

8. The apparatus of claim 2, wherein respective sizes of each first transistor of the plurality of first transistors are different from each other.

9. The apparatus of claim 1, wherein the data driving integrated circuit further comprises:

a shift register;

a latch connected to the shift register;

a digital to analog converter connected to the latch; and a buffer connected to the digital to analog converter.

10. The apparatus of claim 9, wherein the second load signal is applied to the latch and the buffer, and when the second load signal is low, the latch sends image data stored in the latch to the digital to analog converter and the buffer receives and amplifies a output of the digital to analog converter then outputs the amplified signal.

11. A display device comprising:

a plurality of data lines;

a plurality of data driving integrated circuits which applies data voltages to the plurality of data lines; and a signal controller which inputs a first load signal to the plurality of data driving integrated circuits to control the data driving integrated circuits, wherein each data driving integrated circuit of the plurality of data driving integrated circuits includes a load signal converter which generates a second load signal based on the first load signal, and a time when the second load signal begins to rise is the same and begins to fall from high level to low level is different for each data driving integrated circuit of the plurality of data driving integrated circuits according to a input signal.

12. The display device of claim 11, wherein the load signal converter comprises:

a first voltage source;

a second voltage source;

a load signal buffer electrically connected to the first voltage source and the second voltage source, receiving the first load signal and outputting the second load signal;

an inverter connected to the current mirror;

a plurality of first transistors each connected in electrical parallel with each other, the plurality of first transistors being connected between the first voltage source and the load signal buffer and supplying bias current to the load signal buffer; and a pseudo random binary sequence generator connected to the plurality of first transistors.

13. The display device of claim 12, wherein the pseudo random binary sequence generator includes a plurality of cascaded flip-flops, and an output terminal of each flip-flop of the plurality of flip-flops is connected to a control terminal of a corresponding second transistor of the plurality of first transistors.

14. The display device of claim 13, wherein a first flip-flop of the plurality of flip-flops receives an input signal through a logic circuit, the input signal having an arbitrary value and being selected from the output terminal of each flip-flop of the plurality of cascaded flip-flops of the pseudo random binary sequence generator.

15. The display device of claim 12, wherein respective sizes of each first transistor of the plurality of second transistors are different from each other.

16. The display device of claim 12, wherein the load signal buffer comprise:

an inverter;

a resistor connected to the first voltage source; and a second transistor connected to the resistor;

a third transistor connected between the second transistor and the second voltage source; and a fourth transistor, a five transistor, a sixth transistor and a seventh transistor connected in electrical series with each other and all connected between the first voltage source and the second voltage source, wherein a control terminal and an input terminal of the second transistor are connected to a control terminal of the fourth transistor, and a control terminal and an input terminal of the third transistor are connected to a control terminal of the seventh transistor.

17. The display device of claim 16, wherein:

a control terminal of the sixth transistor and a control terminal of the seventh transistor receive the first load signal from the signal controller, an output terminal of each first transistor of the plurality of first transistors is connected to an output terminal of the fourth transistor and an input terminal of the fifth transistor, and an input terminal of the inverter is connected to an output terminal of the fifth transistor and an input terminal of the sixth transistor.

18. The display device of claim 17, wherein the second transistor, the third transistor, the sixth transistor, and the seventh transistor are N-type transistors, and the fourth transistor and the fifth transistor are P-type transistors.

19. A method for driving a display device, the method comprising:

outputting a control signal and a digital image signal including a first load signal to a data driving integrated circuit of a plurality of data driving integrated circuits;

generating a second load signal with the data driving integrated circuit by receiving the first load signal and converting a time when the second load signal begins to fall from high level to low level;

generating a data voltage corresponding to the digital image signal in response to the time when the second load signal begins to fall from high level to low level; and applying the data voltage to a data line to display an image, wherein the time when the second load signal begins to rise is the same and begins to fall from high level to low level is different for each data driving integrated circuit of the plurality of data driving integrated circuits.

* * * * *